United States Patent [19]

Ping

[11] Patent Number: 4,658,844

[45] Date of Patent: Apr. 21, 1987

[54] FOLDING UMBRELLA FRAME

[75] Inventor: Huang S. Ping, Taipei, Taiwan

[73] Assignee: Haustle Products Inc., Taiwan

[21] Appl. No.: 768,350

[22] Filed: Aug. 22, 1985

[51] Int. Cl.[4] ..... A45B 19/00

[52] U.S. Cl. ..... 135/25 A; 135/29

[58] Field of Search ..... 135/25 R, 25 A, 29

[56] References Cited

U.S. PATENT DOCUMENTS

| | | | |
|---|---|---|---|
| 974,643 | 11/1910 | Carlson | 135/25 A |
| 1,202,946 | 10/1916 | Wolf | 135/25 R |
| 2,761,461 | 9/1956 | Mappin et al. | 135/29 |

FOREIGN PATENT DOCUMENTS

| | | | |
|---|---|---|---|
| 1412639 | 11/1975 | United Kingdom | 135/25 A |

*Primary Examiner*—Albert W. Davis, Jr.

*Attorney, Agent, or Firm*—Bacon & Thomas

[57] ABSTRACT

This invention relates to an improved umbrella frame and in particular to one comprising a telescopic stick, a runner slidably mounted on the telescopic stick, a crown fixed at upper end of the telescopic stick, stretcher members pivotally connected with the crown, struts hinged to the runner, links hinged to the struts, control ribs connected with the links, auxiliary links connected at one end with the stretcher members, sleeves each enclosing respective auxiliary link and control rib, and outer dome ribs.

1 Claim, 3 Drawing Figures

FOLDING UMBRELLA FRAME

BACKGROUND OF THE INVENTION

1. Field of the Invention

This invention relates to an improved folding umbrella frame.

2. Description of the Prior Art

Folding umbrella frames are well known in the art and disclosed, for example in U.S. Pat. Nos. 4,007,752, 3,921,655, 3,901,257, 3,853,136, 3,467,115, 2,215,738, 1,249,007 and 580,159.

As to U.S. Pat. No. 4,007,752, it discloses a telescopic umbrella comprising a telescoping stick with a runner slidable thereon from which stretchers are pivoted. The stretchers are connected at the outer ends with dome ribs above each of which is disposed an auxiliary link. The auxiliary link is hinged to a dome rib at one end and to a strut at the other end. A control link is hinged to the strut at a point between two ends thereof. The outer end of the control link is used to control the folding motion of the outer dome rib in dependence on the movement of the umbrella runner.

However, according to this patent, the outer dome rib part is folded upwards so that it is very inconvenient to put the covering cloth attached thereon in order. Furthermore, the hinge points in the fitting is easy to break off.

Regarding to U.S. Pat. Nos. 3,921,655, 3,901,257, 3,853,136, 3,467,115, 2,215,738, 1,249,007 and 580,159, applicant wishes to point out that these references neither suggest nor describe the structure of the subject invention nor, are they possessed of the advantages thereof.

Therefore, it is an object of the present invention to provide an improved folding umbrella frame which may obviate and mitigate the above-mentioned drawbacks.

SUMMARY

This invention is directed to an improved folding umbrella frame.

It is the primary object of the present invention to provide an improved folding umbrella frame the outer dome rib part of which is folded downwards.

It is another object of the present invention to provide an improved folding umbrella frame which may facilitate the covering cloth attached thereon to put in order.

It is still another object of the present invention to provide an improved folding umbrella frame in which the enlarged portion of the first joint is fitted into the stretcher member when the umbrella is open thereby stiffening the structure of the frame.

It is a further object of the present invention to provide an improved folding umbrella frame which is equipped with means for facilitating the opening and folding of the umbrella.

Other objects and advantages of this invention will be obtained by those having ordinary skill in the art when the following detailed description has been read in conjunction with the accompanying drawings wherein like numerals refer to like or similar parts and in which:

DETAILED DESCRIPTION OF THE PREFERED EMBODIMENT

For purposes of promoting an understanding of the principles of the invention, reference will now be made to the embodiments illustrated in drawings. Specific language will be used to describe the same. It will, nevertheless, be understood that no limitation of the scope of the invention is thereby intended, such alternatives and further modifications in the illustrated device; and such further applications of the principles of the invention as illustrated herein being contemplated as would normally occur to one skilled in the art to which the invention relates.

Figure 1:
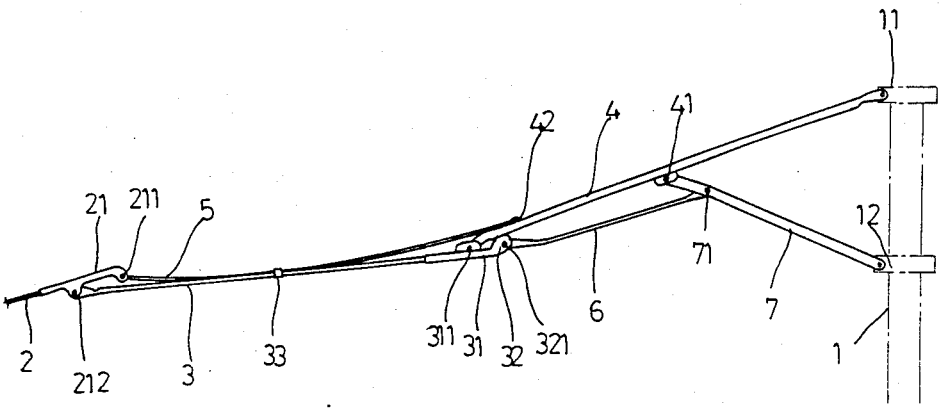
FIG. 1 is a side elevational view of the improved umbrella frame according to the present invention.

With reference now to FIG. 1, there is shown a side elevational view of an improved umbrella frame according to the present invention. The improved umbrella frame 100 is shown comprising a telescopic stick 1, outer dome ribs 2, control ribs 3, stretcher members 4, auxiliary links 5, links 6 and struts 7. The telescopic stick 1 is provided at the top head portion 321 of a first fitting 31. The head portion 321 is located at an enlarged portion 32 of the first fitting 31. The auxiliary link 5 is connected at one end to a joint 42 on the stretcher member 4. The control rib 3 and the auxiliary link 5 are respectively connected to pivotal joint 212 and pivotal joint 211 of a second fitting 21. The control link 3 and the auxiliary link 5 are enclosed by a movable sleeve 33. A canopy (not shown) may be stitched on the outer dome ribs 2 to form a complete umbrella.

Figure 2:
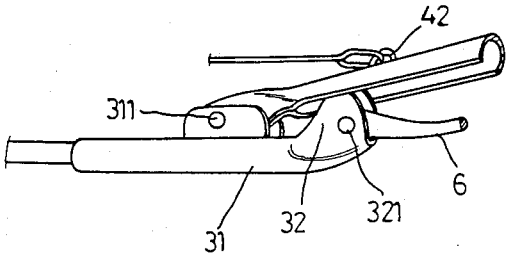
FIG. 2 is an enlarged fragmentary view of the improved umbrella frame.
Figure 3:
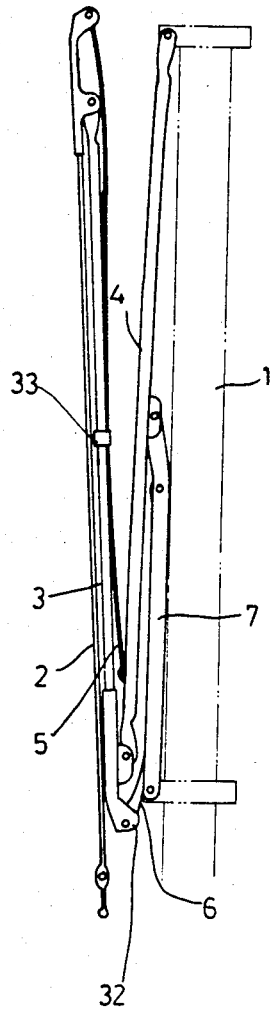
FIG. 3 is a side elevational view showing the fully collapsed state of the improved umbrella.

As the runner 12 is moved downwards along the telescopic stick 1, the outer dome ribs 2, the control ribs 3, the stretcher members 4, the auxiliary links 5, the links 6 and the struts 7 will collapse to the telescopic stick 1 (see FIG. 2). When the runner 12 is pushed upwards along the telescopic stick 1, the outer dome ribs 2, the control ribs 3, the stretcher members 4, the auxiliary links 5, the links 6 and the struts 7 with a crown 11 to which is connected the stretcher members 4. The telescopic stick 1 is further provided with a runner 12 which may slide therealong. The strut 7 is connected to the runner 12 at one end and to a pivotal joint 41 on the stretcher member 4 at the other end. The link 6 is pivoted at one end to a proper point of the strut 7. The other end of the stretcher member 4 and the link 6 are respectively connected to pivotal joint 311 and will expand outwards. In the meantime, the enlarged portion 32 of the first fitting 31 on the control rib 3 is embedded into the stretcher member 4 thereby strengthening the first fitting 31 and the link 6 and therefore, preventing them from breaking off even if subjected to strong wind. Furthermore, it is easy to move down the runner 12 to collapse the umbrella. Moreover, since the auxiliary link 5 is tied to the first rib 3 by a sleeve 33, the resilient force thereof will facilitate the opening and folding of the umbrella.

Although this invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An improved umbrella frame comprising:

a telescope stick;

a crown fixed at upper end of said telescopic stick;

a runner slidably mounted on said telescopic stick;

a plurality of stretcher members pivotally connected at one end with said crown;

a plurality of struts hinged to said runner at one end each strut being connected at the other end with respective stretcher member at a hinge point between two ends of said stretcher member;

a plurality of links each hinged at one end to respective strut at a hinge point between two ends of said strut, and at the other end to a first fitting pivotally connected with the other end of said stretcher member;

a plurality of control ribs each connected at one end with a first fitting and at the other end with a second fitting; auxiliary links connected at one end with the stretcher members at a point intermediate two ends of said stretcher members and at the other end with said second fitting;

a plurality of sleeves each enclosing respective auxiliary link and control rib; and a plurality of outer dome ribs each fixedly connected with said second fitting;

characterized in that said first fitting has an enlarged portion capable of fitting into said stretcher member thereby stiffening said frame.

* * * * *